US011701901B2

(12) United States Patent
Hershfeld

(10) Patent No.: US 11,701,901 B2
(45) Date of Patent: Jul. 18, 2023

(54) CONVEYORS FOR BOX MAKING MACHINES AND METHOD

(71) Applicant: Sun Automation, Inc., Glen Arm, MD (US)

(72) Inventor: Robert Michael Hershfeld, Parkton, MD (US)

(73) Assignee: Sun Automation, Inc., Glen Arm, MD (US)

( * ) Notice: Subject to any disclaimer, the term of this patent is extended or adjusted under 35 U.S.C. 154(b) by 0 days.

(21) Appl. No.: 17/588,252

(22) Filed: Jan. 29, 2022

(65) Prior Publication Data

US 2022/0281231 A1 Sep. 8, 2022

Related U.S. Application Data

(60) Continuation of application No. 15/872,402, filed on Jan. 16, 2018, now Pat. No. 11,235,596, which is a continuation of application No. 15/330,527, filed on Oct. 4, 2016, now abandoned, which is a division of application No. 13/999,578, filed on Mar. 11, 2014, now Pat. No. 9,493,307.

(51) Int. Cl.

| | |
|---|---|
| ***B41J 11/00*** | (2006.01) |
| ***B65H 11/00*** | (2006.01) |
| ***B41F 17/24*** | (2006.01) |
| ***B65H 5/22*** | (2006.01) |
| *B31B 100/00* | (2017.01) |
| *B31B 50/07* | (2017.01) |
| *B31B 50/04* | (2017.01) |
| *B31B 110/35* | (2017.01) |

(52) U.S. Cl.

CPC ..... *B41J 11/007* (2013.01); *B41F 17/24* (2013.01); *B41J 11/0085* (2013.01); *B65H 5/224* (2013.01); *B65H 11/005* (2013.01); *B31B 50/042* (2017.08); *B31B 50/07* (2017.08); *B31B 2100/00* (2017.08); *B31B 2110/35* (2017.08); *B65H 2406/362* (2013.01); *B65H 2406/42* (2013.01); *B65H 2511/10* (2013.01); *B65H 2511/22* (2013.01); *B65H 2511/30* (2013.01); *B65H 2701/1764* (2013.01)

(58) Field of Classification Search

CPC ..... B41J 11/007; B41J 11/0085; B41F 17/24; B65H 5/224; B65H 2406/362

See application file for complete search history.

(56) References Cited

U.S. PATENT DOCUMENTS

| | | | |
|---|---|---|---|
| 4,045,015 | A | 8/1977 | Sardella |
| 4,494,745 | A | 1/1985 | Ward et al. |
| 4,632,378 | A | 12/1986 | Sardella |

(Continued)

*Primary Examiner* — Sharon Polk

(74) *Attorney, Agent, or Firm* — J. Andrew McKinney, Jr.

(57) ABSTRACT

A vacuum belt conveyor sequentially delivers sheet articles to a digital printer. The sheets are held in position by vacuum on the underside of the sheets through apertures in the belt and covered by the sheets. A plurality of independent plenums on the underside of the belt have chambers respectively communicating with rows of apertures extending along the belt. Vacuum is selectively applied from a manifold only to the plenum chambers that supply apertures that are covered by the sheets so that the ink from the printer will not be directed from its intended position on the sheet by vacuum from adjacent uncovered belt apertures.

14 Claims, 9 Drawing Sheets

(56) References Cited

U.S. PATENT DOCUMENTS

| | | | | |
|---|---|---|---|---|
| 4,681,311 | A | 7/1987 | Sardella | |
| 4,889,331 | A | 12/1989 | Sardella | |
| 5,004,221 | A | 2/1991 | Stark | |
| 5,163,891 | A | 11/1992 | Goldsborough et al. | |
| 5,184,811 | A | 9/1993 | Sardella et al. | |
| 6,336,722 | B1 * | 1/2002 | Wotton | B41J 11/0024 347/105 |
| 7,096,529 | B2 | 8/2006 | Phillips et al. | |
| 7,635,124 | B2 | 12/2009 | Sardella | |
| 9,493,307 | B2 | 11/2016 | Hershfeld | |
| 11,235,596 | B2 | 2/2022 | Hershfeld | |
| 2017/0028744 | A1 | 2/2017 | Hershfeld | |

* cited by examiner

INPUT SHAFT ANGLE IS CONSTANT
REGARDLESS OF SHEET LENGTH

SHORT SHEET

SHEET FEED TIME DELAY FEED CYCLE SHIFT

CONVEYORS FOR BOX MAKING MACHINES AND METHOD

CROSS-REFERENCE TO RELATED APPLICATIONS AND CLAIM TO PRIORITY

This application is a Continuation of and claims priority to U.S. patent application Ser. No. 15/872,402, filed Jan. 16, 2018 entitled Conveyers for Box Making Machines, issued as U.S. Pat. No. 11,235,596, which is a continuation of U.S. patent application Ser. No. 15/330,527, filed Oct. 4, 2016, also entitled Conveyors for Box Making Machines, which was a Divisional of and claimed priority to U.S. patent application Ser. No. 13/999,578, filed Mar. 11, 2014, issued as U.S. Pat. No. 9,493,307, also entitled Conveyors for Box Making Machines, the entire disclosures of all of which are expressly incorporated herein by reference and priorities of which are claimed.

FIELD OF THE PRESENT INVENTION

The present invention generally relates to conveyors and methods of conveying articles such as sheets, and more particularly in a preferred form, to conveyors for box making machines where the articles are typically corrugated cardboard sheets called "boards" or "corrugated boards" or even "corrugated" alone.

BACKGROUND OF THE INVENTION

In the field of box-making, sheets, typically corrugated boards, are sequentially conveyed along a horizontal path to one or more stations along the path where operations like cleaning, printing, cutting, slotting or scoring are performed on the boards in a timed sequence. It is essential that the boards arrive at each of the aforementioned work stations in "registration", that is, in a predetermined timed sequence. Various examples of corrugated board conveyors including timed feeders may be found in U.S. Pat. Nos. 4,045,015; 4,494,745; 4,632,378; 4,681,311; 4,889,331; 5,184,811 and, 7,635,124 B2. Several methods of conveying the boards to the various stations along the path are presently in use in the industry. One uses opposed pull rolls which pull the boards through the nip between the rolls. Another method uses rotatable friction rolls made, for example, with a urethane surface on which the boards are maintained by vacuum. This method which is disclosed in U.S. Pat. Nos. 7,096,529 B2, and 5,004,221, is sometimes referred to as "vacuum transfer".

Another vacuum transfer method employs a belt conveyor which supports, the boards while they are held on the conveyor belt by vacuum. This type of conveyance is sometimes referred to as a "vacuum belt conveyor", and one example of such is disclosed in U.S. Pat. No. 5,163,891.

The above methods have been and still are satisfactory where the boards are printed by passage between opposed rolls or cylinders, one being an "impression" roll and the other, a "print" roll having a printing plate 'and ink to transfer the image of the plate to the board in well-known fashion.' However when a digital printer is used instead of the above system, a problem may arise when the boards are conveyed to the printer by a vacuum belt conveyor. In one form of this system, a vacuum transfer unit is used and the conveyor belt is perforated to provide a plurality of holes or apertures that communicate the vacuum with the board to hold the board on the belt. If any of the belt apertures adjacent to the edges of the boards is not covered or closed by the board, ink emitted from these apertures is subject to deviation ("windage") from its intended position on the image being printed on the board. It is understood that the digital printer includes a print head having a plurality of ink discharge ports or nozzles from which the inks are deposited to form the image on the board. If the vacuum used to hold the boards on the conveyor belt is free to divert the flow of ink from the print head to the board to form the desired image, the resulting image will be adversely affected—smudged, distorted, off-color, etc. Such a result is of course not acceptable in the printing industry.

OBJECTS OF THE PRESENT INVENTION

One of the objects of the present invention is to provide novel methods and apparatus for digital printing of articles such as sheets or boards sequentially conveyed along a path, typically a horizontal path. Included herein is the provision of such methods and apparatus that are particularly useful in the digital printing of corrugated boards, for example, in a box-making machine.

A further object of the present invention is to provide a novel vacuum transfer conveyor for use in moving sheet-like articles along a path to be printed by a digital printer positioned at a station along the path. Included herein is such a conveyor that is particularly useful in a box-making machine.

Another object of the present invention is to provide a novel vacuum transfer conveyor for digital printing of sheets which are delivered to a digital printer by a conveyor belt but without adversely affecting the quality of the image printed on the sheets. Included herein is the provision of such a conveyor that will substantially reduce if not solve the problem identified above.

Another object of the present invention is to provide a novel and improved conveyor belt for use in a vacuum transfer conveyor for sequentially feeding sheets to a digital printer for printing on the sheets.

A further object of the present invention is to provide a novel vacuum control system for a vacuum conveyor for controlling the distribution or communication of vacuum to the conveyor belt for holding the sheets on the belt but without adversely affecting digital printing of the sheets at a station along the conveyor.

SUMMARY OF PREFERRED METHODS AND APPARATUS OF THE PRESENT INVENTION

A conveyor is provided having a horizontal endless belt movable along a horizontal path to sequentially deliver sheets, for example corrugated boards, to a digital print station for printing a predetermined, desired image on the boards. The image can of course include numbers, letters, words, designs, shapes, characters, etc. of virtually any type. The printer includes a print head located typically above the conveyor path and including a plurality of ink discharge ports or nozzles for directing ink to the sheets to form the desired image. A vacuum is applied under the top run of the conveyor belt for communication with the sheets through holes or apertures in the belt. A vacuum control system is provided below a section of the belt at a location along the path below the print head so that the flow or communication of the vacuum with each belt aperture may be selectively closed or opened. The operator of the apparatus is configured to open the vacuum (suction) to the apertures covered, by the sheets to hold the sheets on the belt. The operator is configured to close the vacuum to the apertures that are not covered by the sheets and are close enough to the edges of the sheet and would otherwise communicate the vacuum with the ink discharged by the print head to possibly cause unwanted deviation of the ink on the sheet being printed.

In one preferred embodiment, the vacuum control system includes a plurality of independent plenums each having a vacuum chamber in communication with a vacuum manifold having a vacuum chamber communicating with a vacuum source such as a suitable blower. The plenums underlie the conveyor belt and are respectively in communication with the rows of apertures in the belt through, for example, conduits extending between the plenum and manifold chambers. A control member such as a piston-like diverter member is movable to selectively place vacuum in the manifold chamber in communication with one or more plenum chambers to apply vacuum only to the apertures in communication with those plenum chambers.

In one preferred system and method, the sheets are delivered on the conveyor belt offset to one side of the belt so that side of the sheets covers all of the adjacent or nearby apertures of the conveyor belt on that side of the conveyor belt. If the belt apertures on the opposite side of the belt are open (not covered by the sheets), the operator will, through the vacuum control system, block or close the vacuum suction to those apertures so that they cannot communicate the vacuum with the ink being discharged on the sheet by the nozzles to form the desired image. In addition, the vacuum conveyor is supplied with the sheets to be printed by a timed feeder such as, for example, described in U.S. Pat. No. 7,635,124 B2. This feeder times the delivery of the sheets on the vacuum conveyor which moves at a constant speed for a given job or operation, such that the gaps between successive sheets on the belt of the vacuum conveyor do not have any apertures thereby avoiding the possibility of the vacuum reaching through the belt at the sheet edges at the opposite ends of the sheet to deviate or draw the ink from its intended path during a printing operation. To this end the distance or "pitch" between the conveyor belt apertures measured in the direction of sheet travel along the conveyor path, is selected such that the length of the sheet (measured in the direction of sheet travel along the path) plus the gap dimension between successive sheets equals a multiple of the pitch of the belt apertures. Once the desired gap between the sheets is selected, the time cycle of the feeder (see U.S. Pat. No. 7,635,124 B2) may be easily adjusted to deposit each sheet on the belt conveyor at the same predetermined interval of time to form the desired gap between the sheets being conveyed by the vacuum conveyor to the digital printer. In one preferred embodiment, a photoelectric sensor is used to count the belt apertures as they pass the sensor for a given belt speed. Knowing the pitch of the apertures and the length of each sheet, the number of apertures that need to be covered by each sheet fed on the conveyor belt may be determined as well as the amount of the sheet that will extend beyond the forward most and rearward most apertures covered by the sheet.

DRAWINGS

Other objects and advantages of the present invention will become apparent from the following more detailed description of the present invention taken in conjunction with the accompanying drawings in which.

DETAILED DESCRIPTION

Figure 1:
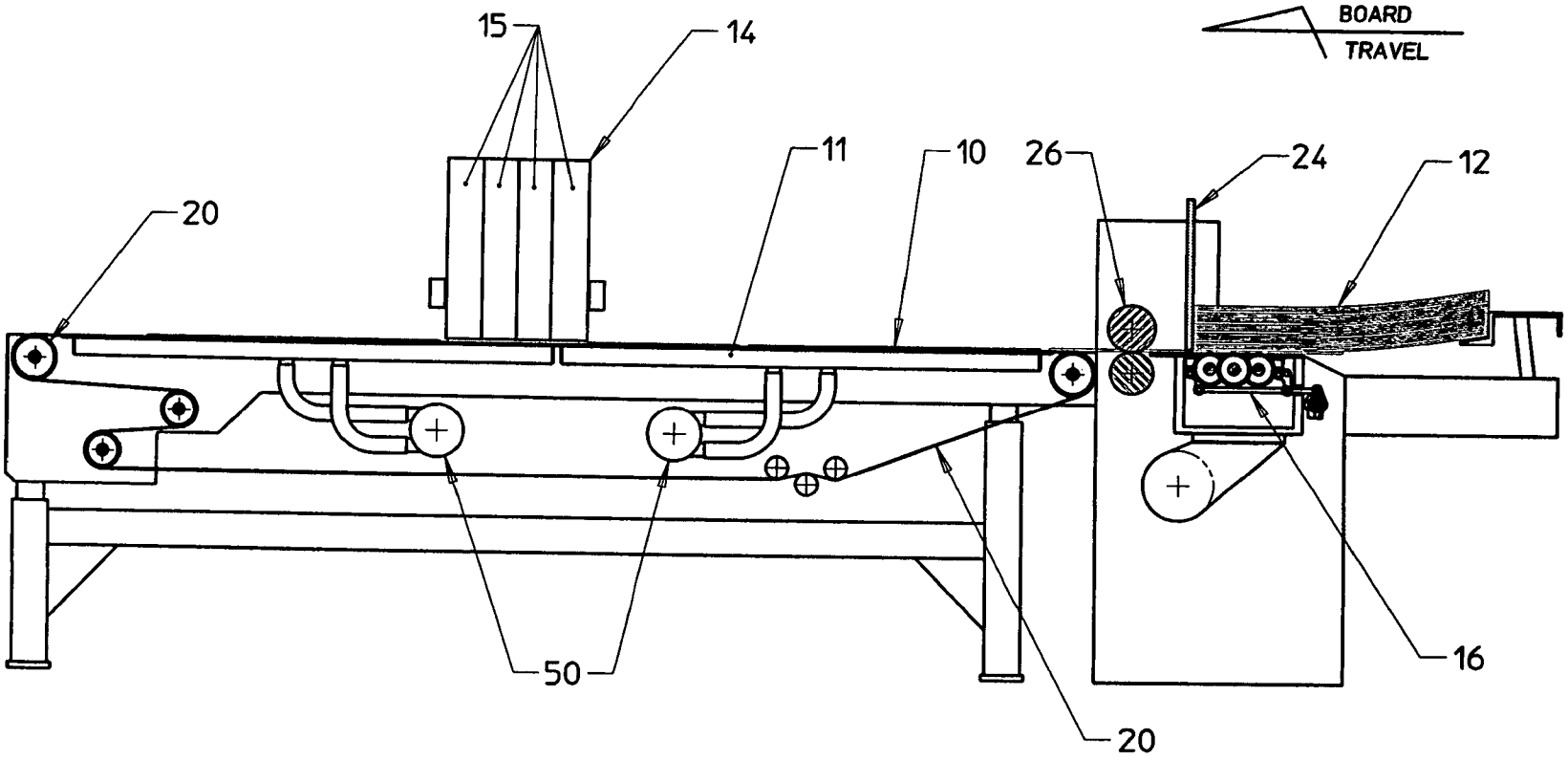
FIG. 1 is an elevational view of a box-making apparatus including a feeder and a belt conveyor for delivering corrugated boards to a digital printer for printing the boards.
Figure 2:
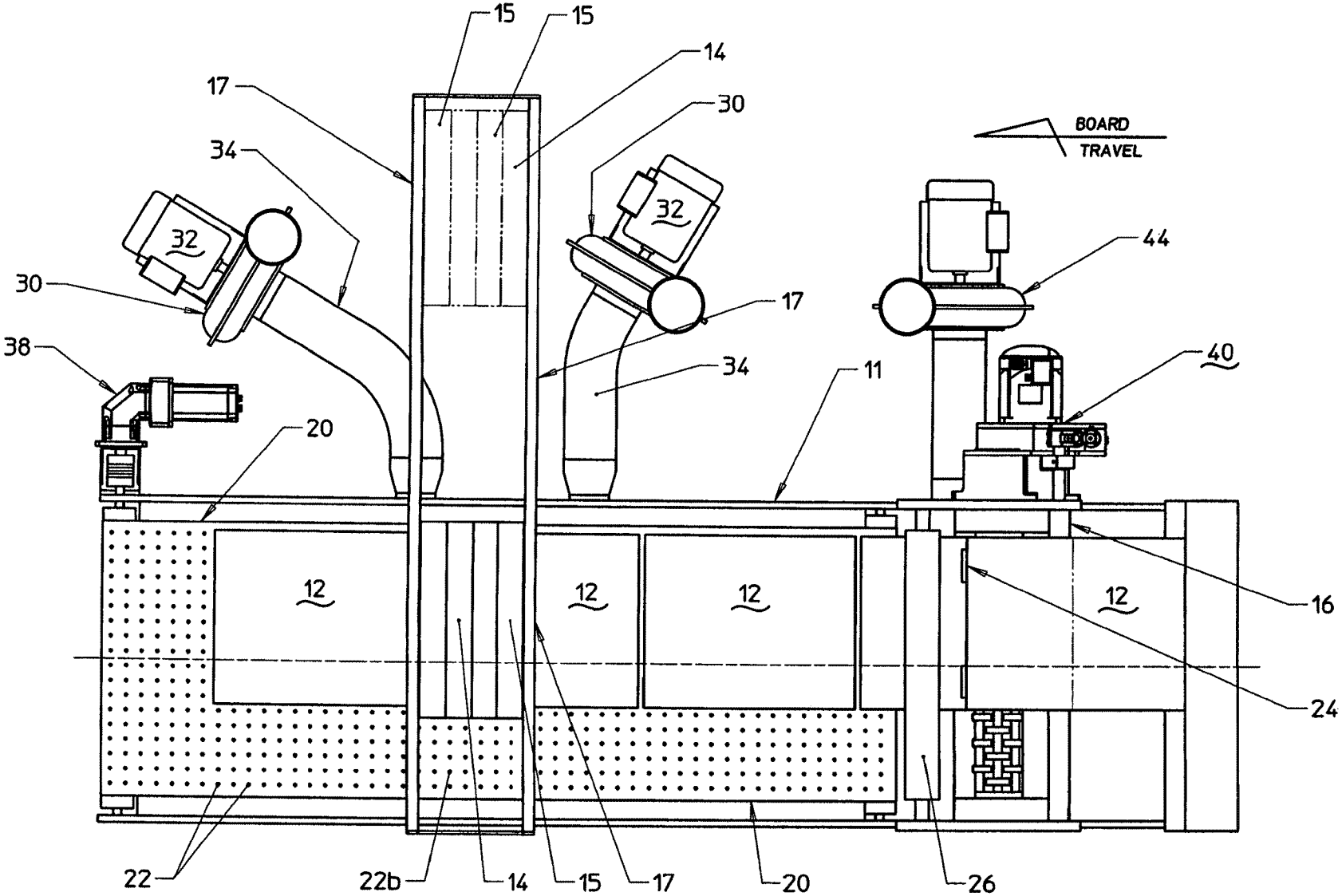
FIG. 2 is a plan view of the apparatus of FIG. 1.
Figures 3, 4, 5:
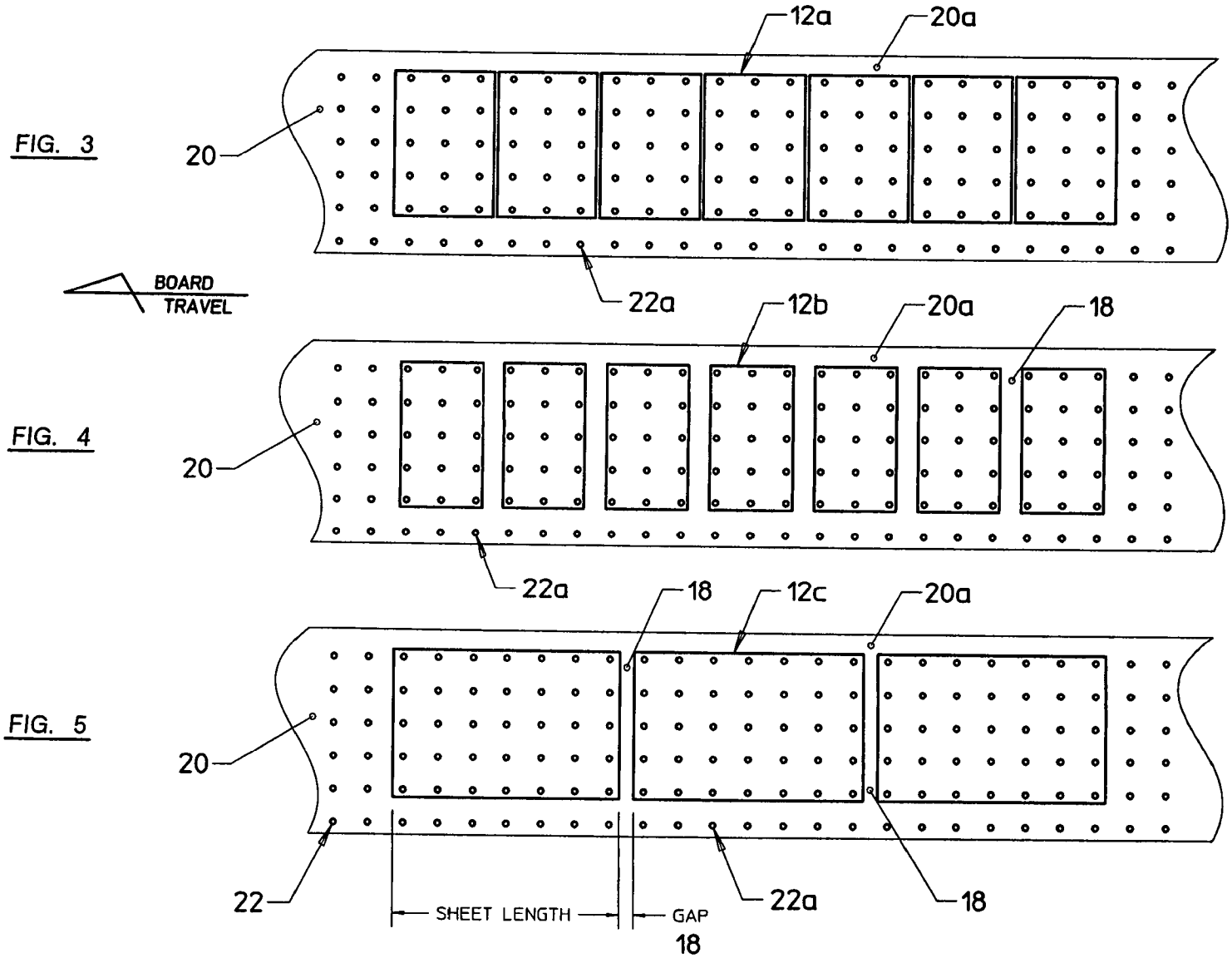
FIGS. 3 to 5 are plan views of sections of the conveyor belt with three different size boards being transported by the belt to the printer (not shown)

Referring to the drawings in detail and initially to FIGS. 1-5, there is shown for illustrative purposes only, one preferred embodiment of the present invention including a belt conveyor 10 for sequentially feeding sheets such as corrugated boards 12 one behind the other in horizontal planes along a horizontal path to a digital printer 14 for printing an image on the top surface of the boards 12 when they arrive below the printer 14. Also shown is a feeder 16 for feeding the boards 12 one by one in a predetermined timed fashion to conveyor 10 from a stack of boards. Feeder 16 is a timed feeder such as described in U.S. Pat. No. 7,635,124 B2 to Sardella whose disclosure is hereby incorporated by reference into the present application as part hereof. For a particular job, feeder 16 delivers a board 12 to conveyor 10 at a predetermined interval of time so that the boards 12 are transported to the printer 14 with the same predetermined space or gap 18 between successive boards, one gap being shown in FIG. 5. Conveyor 10 includes a perforated belt 20 with holes or apertures arranged in rows as shown in FIGS. 3, 4 and 5 which illustrate three different sizes of boards 12*a*, 12*b*, and 12*c* that may be processed for printing in accordance with the present invention.

Feeder 16 in the specific embodiment is a vacuum conveyor and may use a series of conveyor belts or driven rolls engageable with the underside of the boards to drive them under a gate 24 and to the nip of a pair of pull rolls 26 which in turn drive the boards on to the inlet end surface of conveyor belt 20. The latter is driven at a constant speed to sequentially deliver the boards to the printer 14. Boards 12 are positively held on the conveyor belt 20 by vacuum supplied by a vacuum control system generally designated 28 to the underside of the boards 12 through the belt apertures 22. FIG. 2 shows the blowers 30 and their motors 32 which remove air from below the boards 12 on the conveyor belt 20 and through the belt apertures 22 and conduits 34 thereby producing a vacuum for positively holding the boards 12 on the conveyor belt as the latter transports them along the conveyor path. FIG. 2 also shows a motor (unnumbered) for driving the downstream end sprocket 38 (shown above the motor driving the sprocket 38) of the conveyor 10 through any suitable transmission. In addition, FIG. 2 shows a servo motor and a transmission generally at numeral 40 for driving the feeder 16 in a timed fashion as will be further described below. In the embodiment of the feeder 16 which utilizes a vacuum to hold the boards 12 on the transport rolls or endless belts, a blower such as shown in FIG. 2 at 44 may be used to produce the vacuum under the boards 12. A more detailed description of feeder 16 including its transmission 40 is disclosed in above-identified U.S. Pat. No. 7,635,124 B2.

The Printer

Printer 14 is a commercially available ink jet printer including a plurality of print heads for four colors. For example, one printer could have twenty (20) print heads with five (5) heads per color. A larger printer for printing larger sheets could have forty-eight (48) print heads with twelve (12) heads per color. All of the heads for each color are assembled together into a print bar. Printer 14 of the shown embodiment has four (4) print bars 15 shown in FIGS. 1 and 2. The print heads of course have nozzles for discharging ink on the sheet to form the desired image, character or any desired indicia, etc. on the sheets. A print head could have as many as 2,656 nozzles. Also the nozzles can be spaced from the sheet being printed in a range of 1 to 4 mm. but when printing corrugated board a spacing of 3 mm. is preferred. In the specific embodiment shown, print bars 15 are mounted for movement in a holder 17 between an operative position shown in FIG. 2 for printing the sheets 12 and in inoperative position on the drive side of the conveyor 10 as shown in phantom lines in FIG. 2. The printer may be slid along holder 17 into any desired position over the sheet 12 in order to print the desired image at the desired location on the sheet 12. Various printer sizes can be used depending on the size of the sheet. A maximum sheet size for one machine could be for example 1000 mm. (width—across the machine) by 1600 mm. A minimum sheet width could be for example 250 mm. The print width equals the sum of the print width of all heads of a single color. For a five head system this amounts to a print width of about 23" (inches) and for a twelve head system a print width of about 53" (inches). One preferred method that may be used to practice the present invention uses a drop on demand ink jet print head which can print at speeds up to 200 meters per minute at 600.times.480 dpi. In addition to the print head described above, printer 14 includes pumps and a controller including a computer for controlling the print head and sending image data in accordance with a print program. The entire printer, also termed "print engine" in the art, is commercially available.

Vacuum Control System

Figure 6:
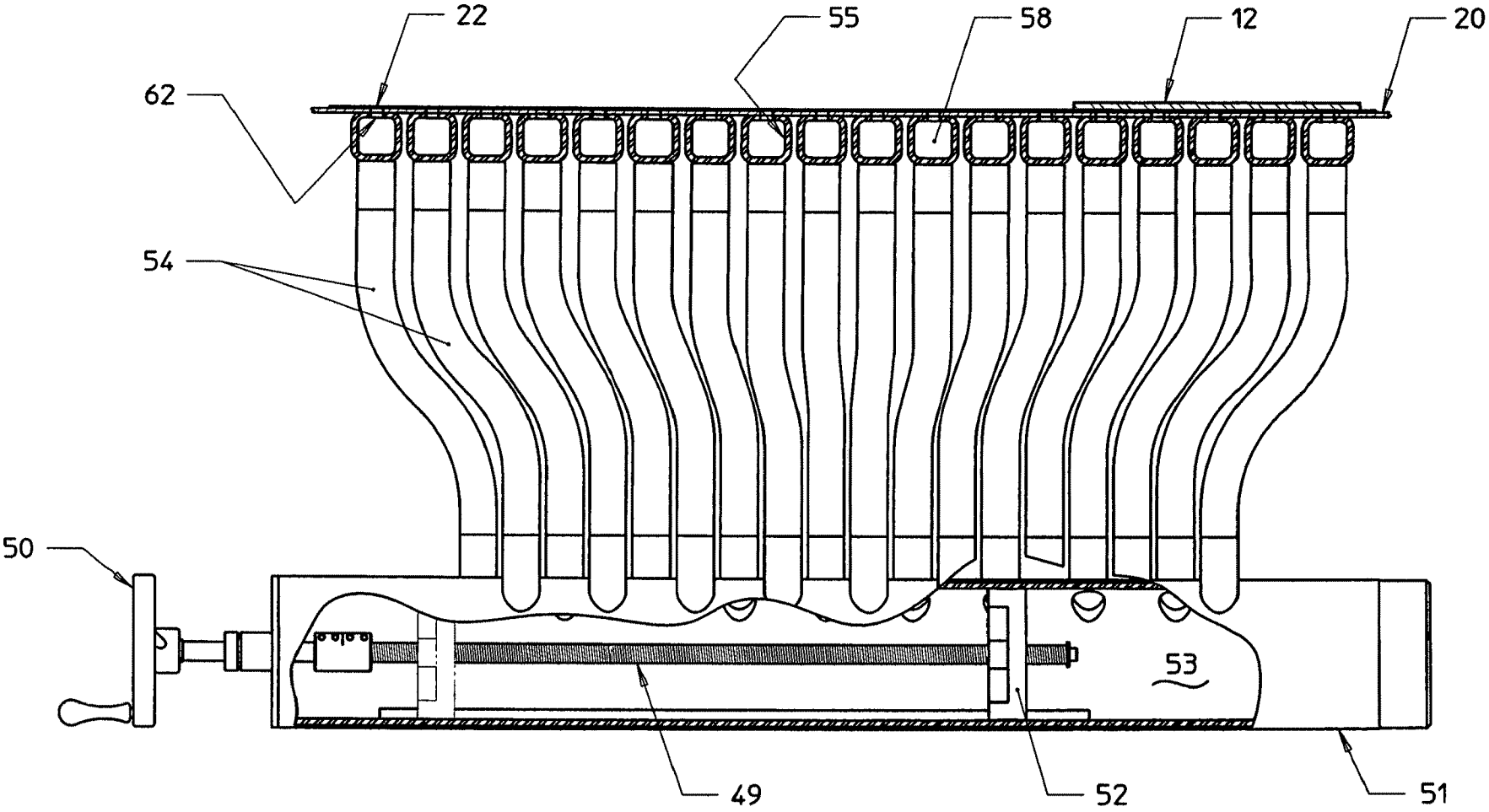
FIG. 6 is an enlarged cross-sectional view taken transversely of the belt conveyor.
Figure 7:
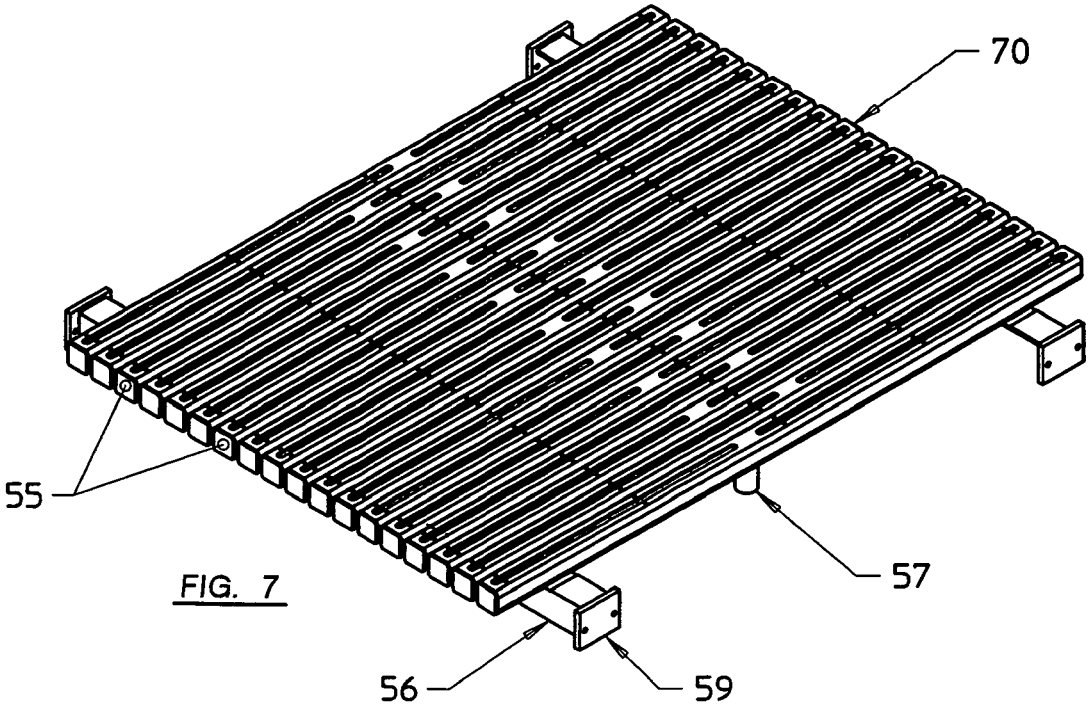
FIG. 7 is a plan view in perspective of a system of vacuum plenums underlying the top run of the belt conveyor for supporting the belt and supplying vacuum to the sheets through apertures in the belt.
Figure 8:
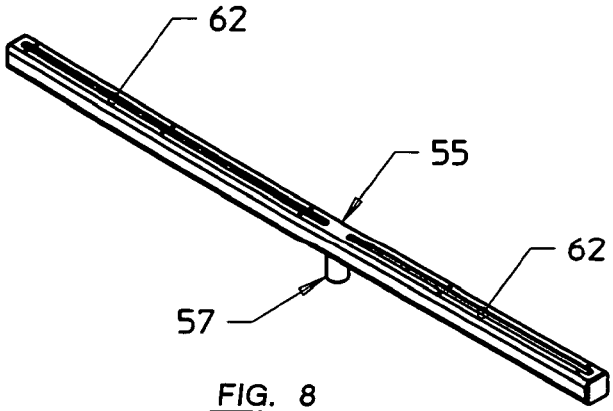
FIG. 8 is a perspective view of one of the plenums shown in FIG. 7 to an enlarged scale.

Referring to FIGS. 6-8, a vacuum control system is provided for controlling the vacuum applied to the apertures 22 of the conveyor belt 20 to hold the sheets in position on the conveyor belt 20. Vacuum blowers 30 respectively driven by motors 32 shown in FIG. 1 produce a vacuum or suction in conduits 34 (see FIG. 2) which communicate with a vacuum manifold 51 (see FIG. 6) through conduits such as hoses. Manifold 51 encloses a vacuum chamber 53 from which a plurality of conduits such as hoses 54 extend to communicate the manifold chamber 53 with a plurality of independent plenums 55 shown in FIGS. 7 and 8. In the preferred embodiment shown, plenums 55 provide the support surface of the upper run of the belt 20 of conveyor 11. Plenums 55 extend longitudinally along the conveyor path and are assembled to and fixed on, in side by side abutting relationship, underlying base pieces 56 which in turn are fixed through flanges 59 to opposite sides of the conveyor frame generally designated 11 at an upper portion thereof. Plenums 55 are each elongated and hollow to provide independent elongated vacuum chambers 58 which respectively communicate with the rows of belt apertures 22 extending along the path of conveyor belt 20. To that end, plenums 55 each have a slot 62 (see FIG. 6) in its top wall communicating with only one row of belt apertures 22. Therefore each row of belt apertures 22 extending along the conveyor path is in communication with plenum chamber 58. Plenums 55 may be molded or otherwise made from any suitable metallic material, and in the specific embodiment shown, include a depending pin 57 for locating the plenum in position in a top frame portion of conveyor 10. Although only one plenum assembly 70 is shown in FIG. 7 it will be understood that a plurality of plenum assemblies may be used in continuous fashion under the conveyor belt 20 throughout the entire length of the conveyor belt or throughout a length sufficient to accommodate and print any size of sheet without vacuum interference with the flow of ink at the edge areas of the sheet. Also in other forms of the invention, the plenums can be combined with the manifold in one unit or can be directly supplied with vacuum from other sources.

In order to block or close the vacuum at certain apertures for example apertures 22*b* in FIG. 2 or 22*a* in FIGS. 3-5, the operator rotates hand wheel 50 to rotate screw rod 49 to axially move diverter 52 along the manifold chamber 53 until vacuum in chamber 53 is blocked from the appropriate conduit 54 leading to the plenum chamber 58 which communicates with the row of apertures 22*b* or 22*a* whichever the case may be. It will be seen that one or more plenum chambers 53 may be blocked from vacuum in the manifold 51 by the same position of diverter 52 in the manifold chamber, it being understood that each plenum 55 communicates or is in registry with only one row of apertures 22 that extend in the longitudinal direction of conveyor belt 20.

Operation

Depending on the size of the boards 12 being processed, the timing of the deposit of the boards 12 on the conveyor 10 is selected such that the gap 18 (see FIG. 5) between successive boards 12 as they are being conveyed on the conveyor 10 will not overlie any of the belt apertures 22 so that the printing ink issuing from the printer 14 will not be distorted, diverted or deviate into the marginal areas of the boards at the edges adjacent the gaps 18. To that end the gap 18 is selected so that the length of the board (measured in the direction of the travel path) plus the size of the gap (measured in the direction of the travel path) will equal a multiple of the "pitch" of the belt apertures (where the pitch is the distance between adjacent apertures 22 measured in the direction of sheet travel. FIGS. 3-5 illustrate three different size boards 12*a*, 12*b* and 12*c* as they would appear on the conveyor belt 20. In each case, the gaps 18 between the boards do not overlie any of the belt apertures 22. Also it should be noted that the boards 12*a*, 12*b*, and 12*c* are offset or "justified" towards one side of the conveyor belt 20 so that there are no belt apertures 22 in the marginal areas 20*a* between the boards and the edges of the belt on that side. Preferably that side of the conveyor is the "drive side" where the motors and drive 40 of the feeder 16, vacuum blowers 32, 34 and drive 38 for conveyor 10 are located. The opposite side is termed the "operator side" where the operator controls and oversees the operation of the machine. Referring to FIG. 1, standing on the operator side, the operator closes the flow of vacuum to the apertures 22*a* by rotating the spindle 50 to move the diverter 52 to block the vacuum flow to apertures 22*a* so that the ink being deposited on the boards will not deviate or otherwise be diverted from its intended path in the formation of the desired printed image on the board. FIG. 2 shows a conveyor belt 20 having a different size than the belt in FIGS. 3-5. The belt 20 in FIG. 2 also has more apertures 22 than the belt shown in FIGS. 3-5. The operator will block off the vacuum to the apertures 22*b* on the operator's side of the conveyor of FIG. 2 in the area of the printer 14.

Figure 9:
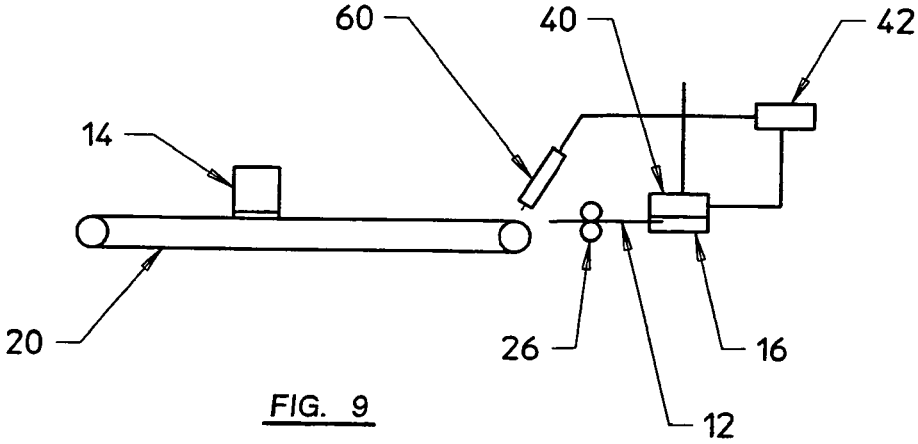
FIG. 9 is a schematic view of a circuit including a sensor for sensing the apertures in the belt and controlling the actuation of the feeder which feeds the sheets to the conveyor belt.

The feeder 16 and the conveyor belt 20 must be in time or synchronized so that sheets 12 can be fed on and carried by the belt at a calculated position relative to the belt apertures 22. In order to arrive at a gap 18 between successive sheets 12, the length or dimension of the sheet 12 (measured in the direction of the conveyor path) and the dimension of the gap (measured in the direction of the conveyor path) must add up to a multiple of the pitch of the belt apertures 22 which are equally spaced from each other in each of the rows of apertures. Knowing the length of the sheet 12, plus the number and pitch of the belt apertures 22 in a row, and the speed of the conveyor belt 20, the computer 42 (FIG. 9) can calculate the distance the sheet will extend beyond the covered apertures 22 at each end of the sheet in order to center the sheet over the apertures 22 that the sheet covers. A photoelectric sensor 60 shown in FIG. 9 counts the apertures 22 as they pass the photoelectric cell and sends it to the computer 42 to activate the feeder 16 after, a certain interval of time which has been calculated, taking into account the known factors described above. The feeder 16 then feeds a sheet to the conveyor 20, and the process is repeated and a sheet 12 is fed to the conveyor 20 at the same intervals of time until the job is completed or otherwise terminated. When a new printing operation is to be run on sheets 12 of a different size, the interval of operation (the time cycle) of feeder 16 can be easily adjusted as taught in U.S. Pat. No. 7,635,124 B2 to suit the different size of the sheets 12. This is a significant advancement in the box-making art since the repeat time or time cycle of operation of conventional feeders is constant regardless of the size of the boards being processed.

Figure 10:
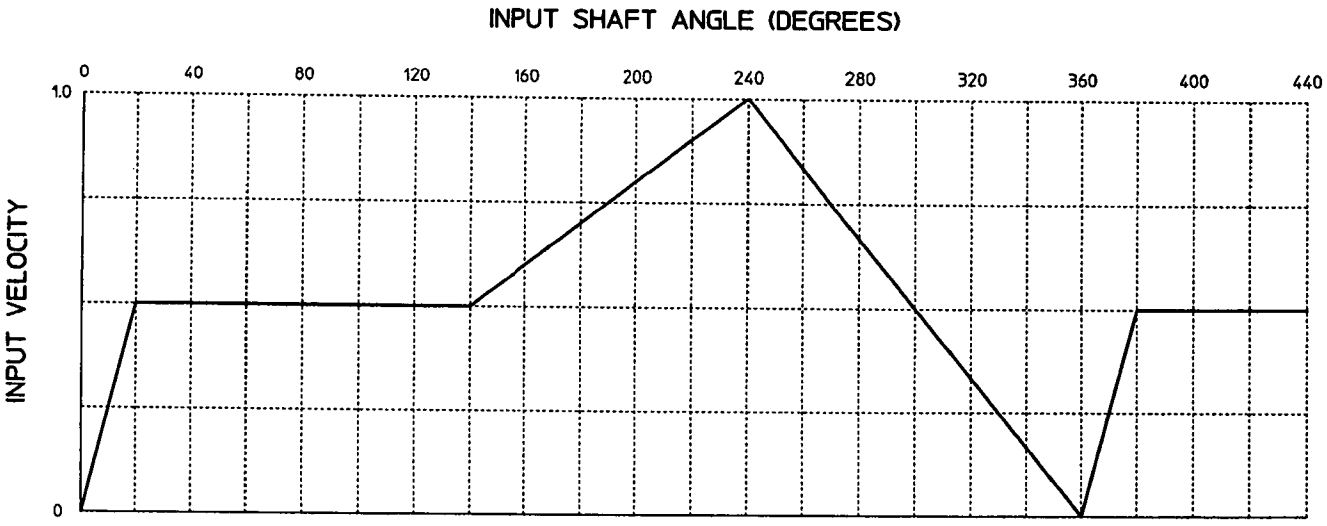
FIG. 10 is a graph of the input shaft position (angle) versus its velocity of a feeder for delivering sheets to a belt conveyor in accordance with a preferred form of the present invention.
Figure 11:
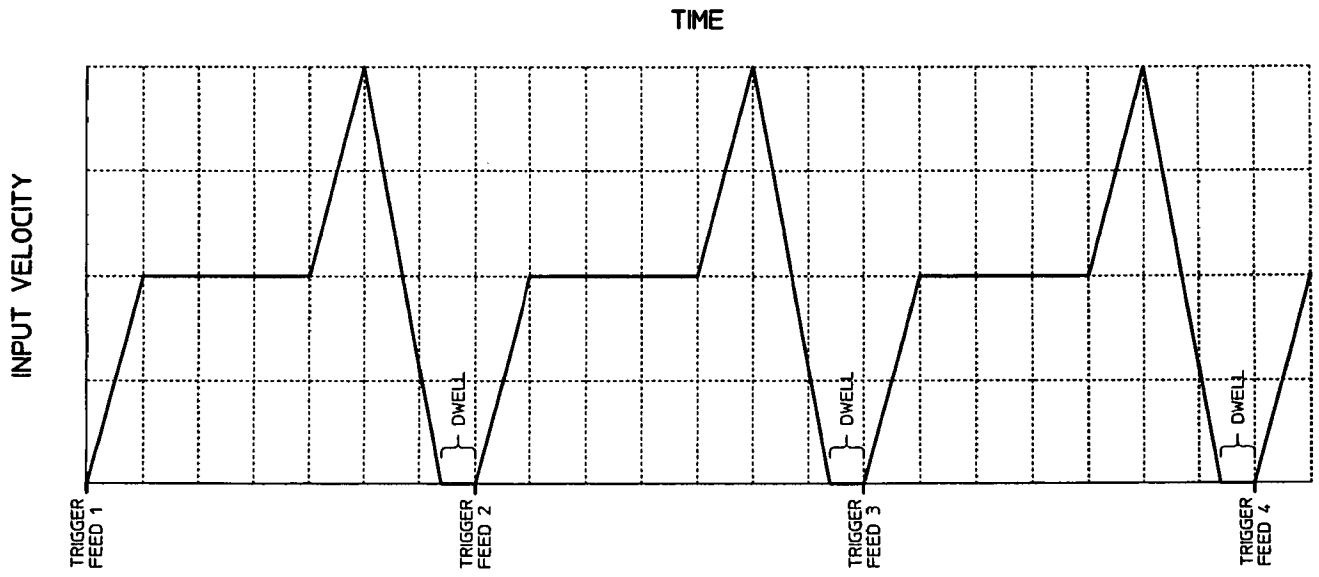
FIG. 11 is a graph similar to FIG. 10 for short sheets being fed.
Figure 12:
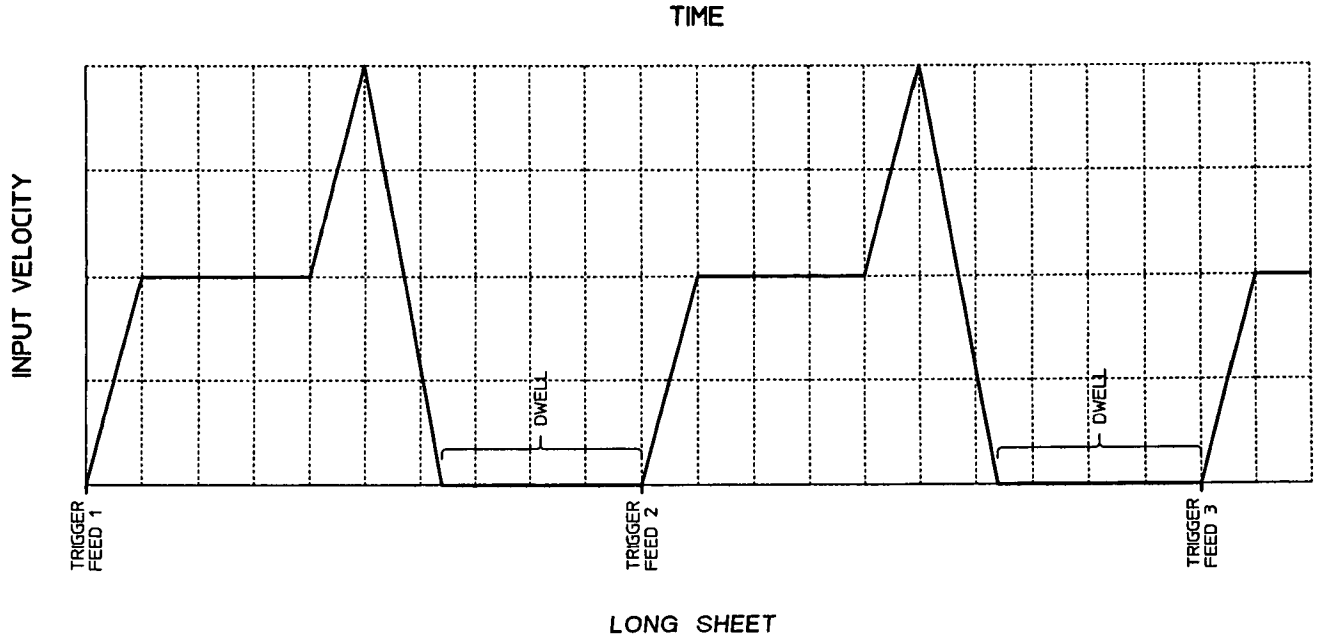
FIG. 12 is a graph similar to those above except it is for long sheets being fed.

In the form of the invention just described above, the initiation of the feed of sheets 12 to conveyor 10 is timed based on the pitch or distance between the holes or apertures 22 in a conveyor belt where the holes are equally spaced from each other in the longitudinal and transverse directions of the belt. However in another and preferred method of the present invention, initiation of the feed is not dependent on a predetermined pitch or spacing between the apertures 22. Rather it is based on the actual position of the apertures 22 during operation and will therefore not be affected if the actual pitch of the apertures is different than the predetermined pitch of the apertures or if the apertures are not equally spaced from each other. In the present method, the feeder 16 is reregistered to the true position of the apertures 22 in the conveyor belt on each and every feed of sheet, and therefore requires that initiation of the feed of each sheet 12 by feeder 16 occur at the same position (angle) of the input shaft of feeder 16 every time. After each sheet feed, the transmission of feeder 16 always returns to its starting position and stops. In this preferred method of the present invention, the input motion profile over the 360 degree transmission cycle is not a function of sheet size and the input velocity is, scaled up or down based on machine speed, as shown in FIG. 10. A dwell is added between each cycle of the feeder 16 to allow for different sheet sizes. FIGS. 11 and 12 show how this dwell changes for short sheets and long sheets. For the shortest sheet that can be fed there is almost no dwell time. In all cases the feeder input shaft returns to a stop after feeding each sheet. A servo motor is used in feeder 16 to achieve this motion profile.

Figure 13:
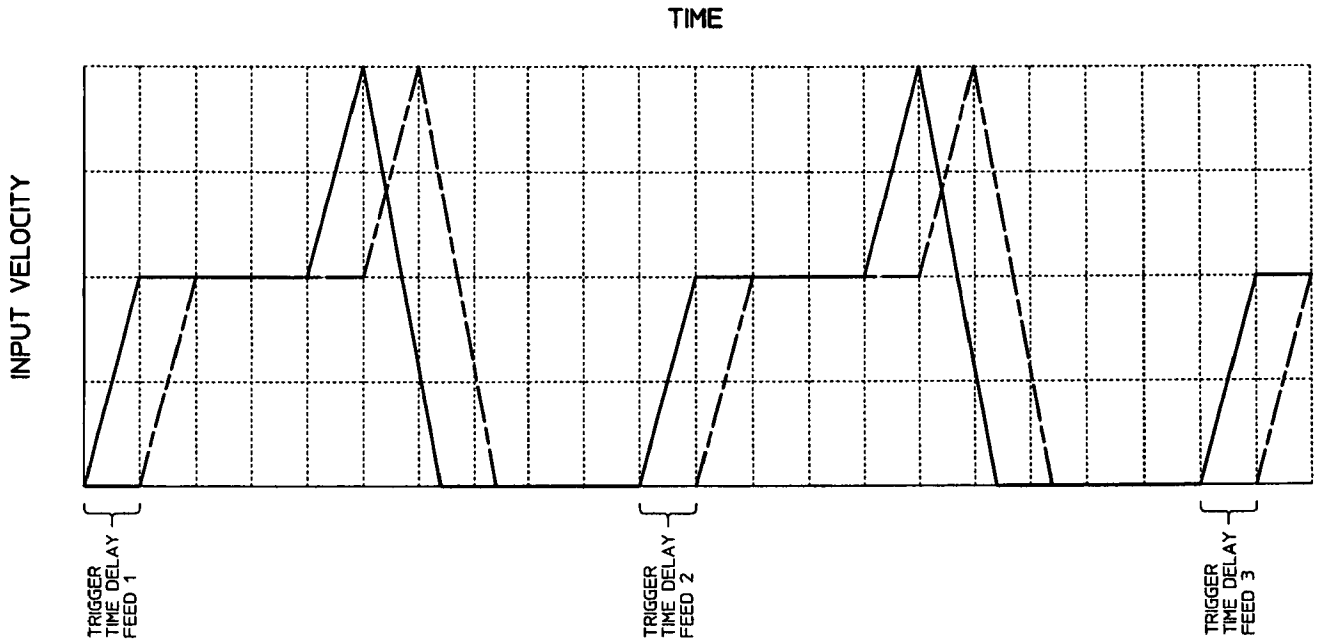
FIG. 13 is a graph similar to those above except it shows a time delay for shifting the position of the sheet relative to the apertures in the conveyor belt.

When the feed cycle is initiated in response to the actual position of holes 22 in the belt, the position of the sheet relative to the holes in the belt is shifted to the desired position through a time delay. FIG. 13 shows how the calculated time delay is used to shift the actual feeding of the sheet relative to the trigger signal from the belt hole sensor 60. This could also be done by using an encoder that is measuring the position of the conveyor belt. Instead of applying a time delay to shift the feed cycle, it could wait a certain number of encoder counts after seeing a hole in the belt to start the feed cycle. Each method provides the same result.

Although the belt conveyor 10 shown and described above includes a single belt 20, it will be understood that it may include two or more belts (not shown) arranged in side by side relationship.

Although preferred forms of the method and apparatus of the present invention have been shown and described above, variations of the present inventions will become apparent to those skilled in the art but without departing from the scope of the invention appearing in the following claims.

What is claimed is:

1. A conveyor apparatus comprising in combination:

a conveyor comprising a conveyor belt (10) movable along a path for moving articles (12) along the path, said belt (10) having a plurality of apertures (22) for introducing a vacuum to the articles (12) on said belt (10) to hold the articles (12) on said belt (10);

a selector configured to selectively open first apertures of said plurality of apertures (22) to a source of vacuum and to selectively close second apertures of said plurality of apertures (22) to the source of vacuum while said first apertures of said plurality of apertures (22) are open to the source of vacuum; and a feeder configured to feed the articles (12) on to said belt (10), the feeder configured to exclude any apertures of said plurality of apertures from positioning in gaps (18) between the successively fed articles (12) on said belt (10), the feeder further configured to feed the articles on said belt (10) in a timed manner such that leading and trailing edges of the articles (12) are positioned between one or more of said first apertures of the plurality of apertures (22), wherein said plurality of apertures (22) are arranged in rows extending along the path and said apertures (22) are spaced from one another by a pitch such that a dimension of the articles (12) measured along the path plus a dimension of the gap (18) measured along the path equals a multiple of said pitch.

2. A conveyor apparatus according to claim 1, wherein at least one of said second apertures of said plurality of apertures (22) is positioned on said belt (10) outwardly of an edge of the articles (12).

3. A conveyor apparatus according to claim 1, wherein the feeder is further configured to position the articles (12) on said belt (10) offset to one side of said belt (10) over one or more of said first apertures (22).

4. A conveyor apparatus according to claim 1, wherein said apertures (22) in each of said rows are equally spaced from one another.

5. A conveyor apparatus according to claim 4, further comprising a sensor configured to sense said apertures (22) in said belt (10) as said belt (10) is moving along the path and for sending a signal for feeding the articles (12) to the said conveyor for printing the articles (12).

6. A conveyor apparatus according to claim 5, wherein said conveyor further comprises a plurality of independent plenums having chambers respectively communicating with groups of said apertures (22), and means for selectively applying a vacuum to said plenums for supplying said first apertures (22) with the vacuum.

7. A conveyor apparatus according to claim 1, further comprising a vacuum chamber and a control member movable in said vacuum chamber for selectively communicating said vacuum chamber with said apertures (22) in said belt (10).

8. A conveyor apparatus according to claim 7, further comprising a digital printer for printing articles on said belt (10), said digital printer comprising a print head overlying said belt (10) whereby ink flowing from said print head will not be affected by vacuum when said second apertures of said plurality of apertures (22) are closed.

9. A conveyor apparatus according to claim 8, further comprising a box making machine including a belt conveyor, wherein the articles (12) are boards to be printed as the boards are conveyed along the path under said digital printer.

10. A method of conveying articles (12) along a path, the method comprising:

sequentially conveying the articles (12) along the path with a vacuum belt conveyor having a plurality of apertures (22) in the belt (10) for holding the articles (12) on the belt (10) by a vacuum selectively applied to first apertures of the plurality of apertures (22), the first apertures being covered by the articles (12);

excluding the vacuum from second apertures of the plurality of apertures (22) in the belt (10), the second apertures being located outwardly of and adjacent edges of the articles; and sequentially depositing the articles (12) on the belt (10) in a timed manner, with gaps (18) between the successively deposited articles (12) without any of the plurality of apertures (22) in the gaps (18), said sequentially depositing comprising feeding the articles on the belt in a timed manner such that leading and trailing edges of the articles (12) are positioned between one or more of the first apertures of the plurality of apertures (22) in the belt (10), wherein the apertures (22) are in rows extending along the path and are spaced from one another by a pitch such that a dimension of the article (12) measured along the path plus a dimension of the gap (18) measured along the path equals a multiple of the pitch.

11. A method according to claim 10, wherein said sequentially depositing further comprises depositing the articles (12) on the belt (10) offset to one side of the belt (10) and covering all of the first apertures (22) covered by the articles (12).

12. A method according to claim 11, further comprising sensing the apertures (22) in the belt (10) as the belt (10) moves along the path, and sending a signal for feeding the articles (12) on the conveyor with the gaps between the articles.

13. A method according to claim 12, wherein the apertures (22) in the belt (10) are arranged in rows, and wherein the method further comprises providing the vacuum to selected apertures of the plurality of apertures by plenum members underlying the belt (10), each of the plenum members having vacuum passages respectively communicating with different groups of apertures.

14. A method according to claim 13 wherein the articles (12) are sheets to be printed by a digital printer positioned along the path.

* * * * *